US006155764A

United States Patent [19]

Russo

[11] Patent Number: 6,155,764

[45] Date of Patent: Dec. 5, 2000

[54] SUPPORT FOR WEARING ON THE TORSO AND SUPPORTING AND RAISING A CEILING PANEL

[76] Inventor: Angelo Russo, 162 Arthur St., Massapequa Park, N.Y. 11762

[21] Appl. No.: 09/285,962

[22] Filed: Apr. 5, 1999

[51] Int. Cl.[7] ..... E04G 21/14

[52] U.S. Cl. ..... 414/11; 224/270; 224/221; 269/3

[58] Field of Search ..... 224/270, 266, 224/265, 181, 200, 201; 2/171; 5/83, 86, 87, 89; 414/10, 11; 269/3

[56] References Cited

U.S. PATENT DOCUMENTS

| | | | |
|---|---|---|---|
| 4,158,489 | 6/1979 | Gottschalk et al. | 352/243 |
| 4,438,763 | 3/1984 | Zablen | 128/133 |
| 4,874,120 | 10/1989 | Paton et al. | 224/266 |
| 5,020,941 | 6/1991 | Bulin et al. | 405/186 |
| 5,050,245 | 9/1991 | Nearhood | 2/410 |
| 5,129,774 | 7/1992 | Balseiro et al. | 414/11 |
| 5,220,704 | 6/1993 | Flynn et al. | 15/321 |
| 5,255,394 | 10/1993 | Long | 2/410 |
| 5,460,126 | 10/1995 | Szelewski | 119/859 |
| 5,593,145 | 1/1997 | Sprayberry | 269/3 |
| 5,636,383 | 6/1997 | Cwiakala | 2/171 |
| 5,826,763 | 10/1998 | Roberts | 224/270 |
| 5,904,282 | 5/1999 | Gleason | 224/635 |
| 5,941,436 | 8/1999 | Washington et al. | 224/270 |
| 6,028,257 | 2/2000 | May | 84/421 |

*Primary Examiner*—Joseph A. Fischetti
*Attorney, Agent, or Firm*—Richard L. Miller

[57] ABSTRACT

A support for wearing on the torso and supporting and raising a ceiling panel. The support includes a harness that engages the torso and a frame that is operatively connected to the harness and supports and raises the ceiling panel. The frame includes a pair of rods that extend upwardly and aligningly along the harness and an H-pipe that has a pair of uprights. Termination ends of the pair of rods extend snugly through lower restricted bores in the H-pipe. The frame further includes a pair of coil springs that are captured in the pair of uprights of the H-pipe and sit on the termination ends of the pair of rods. Upper ends of the uprights of the H-pipe contain ball sockets. The frame further includes a pair of balls that are rollingly received in the ball sockets in the H-pipe so as to form ball joints. The pair of balls have necks that extend freely through upper restricted bores in the H-pipe and supporting portions that diverge from the necks. The supporting portions of the pair of balls have rubber pads thereon that are flat and raise the ceiling panel and support the ceiling panel when the ceiling panel is against a ceiling and the pair of coil springs provide tension thereon.

12 Claims, 1 Drawing Sheet

SUPPORT FOR WEARING ON THE TORSO AND SUPPORTING AND RAISING A CEILING PANEL

BACKGROUND OF THE INVENTION

1. Field of the Invention

The present invention relates to a support. More particularly, the present invention relates to a support for wearing on the torso and supporting and raising a ceiling panel.

2. Description of the Prior Art

Numerous innovations for body mounted supports have been provided in the prior art that will be described. Even though these innovations may be suitable for the specific individual purposes to which they address, however, they differ from the present invention.

A FIRST EXAMPLE, U.S. Pat. No. 4,158,489 to Gottschalk et al. teaches a body-mounted support device for a motion picture or television camera that employs a pair of articulated arm assemblies attached to a body support and positioned to support a gimbal device. A camera support tube is mounted on the gimbal device and carries the motion picture or television camera on its upper end, and a battery at its lower end. Pneumatic cushion means associated with the articulated arm assemblies dampen unwanted movements of the motion picture camera. An emergency release mechanism is provided to disconnect the entire device from the body support. Telescoping parts of the camera support tube permit the camera to be operated from a very low elevation with respect to the floor as well as allowing vertical adjustment of the center of gravity of all of the parts supported upon the gimbal device.

A SECOND EXAMPLE, U.S. Pat. No. 5,050,245 to Nearhood teaches a combination protective head gear and cephalic tool for construction workers that is made of a thick cylindrical member having therein a soft cushioning material attached to a thin, relatively hard disk, the cylindrical member being enclosed in a fabric and adapted with straps to fit snugly on top of a wearer's head to provide the construction worker with a tool for carrying large sheets of building material and which tool allows manipulating and orienting the building material sheet while on top of the head into place for construction of a ceiling.

A THIRD EXAMPLE, U.S. Pat. No. 5,129,774 to Balseiro el al. Leaches an apparatus for lifting a panel to a ceiling that has a post having an upper end and a lower end, a spring in the post between the upper and lower ends for at least limited longitudinal compression of the post against a spring force, and a foot pivoted on the lower end about a foot axis transverse to the longitudinal axis. A handle is pivoted on the post between its ends about a handle axis generally parallel to the foot axis and a panel-engaging support bar is pivoted on the upper end of the post about a bar-pivot axis generally parallel to the foot and handle axes, extends perpendicular to this bar-pivot axis, and has one end provided with an outwardly directed cleat. Thus this bar can be engaged under the panel with the cleat against an edge of the panel. At least one bar spring is operatively engaged between the bar and the post for biasing the bar into a position extending perpendicular to the post.

A FOURTH EXAMPLE, U.S. Pat. No. 5,255,394 to Long teaches a device for supporting an overhead load such as a drywall panel in an overhead location, consisting of a helmet including a hard hat and a rotatable flat turntable supported from the hard hat. In one form, a base for the rotatable turntable is demountable supported on the hard hat, and in the alternate form, the bearing for supporting the turntable is formed integrally of the hard hat.

A FIFTH EXAMPLE, U.S. Pat. No. 5,636,383 to Cwiakala teaches a rotatable, head mounted support apparatus for supporting drywall and other ceiling panels during the construction of a ceiling. The rotatable, head mounted support apparatus is preferably secured to the top of a hard hat, and includes rotatable, turntable-type bearing which allows a construction worker to freely swivel his or her head during the installation of a drywall panel.

It is apparent that numerous innovations for body mounted supports have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a support for wearing on the torso and supporting and raising a ceiling panel that avoids the disadvantages of the prior art.

ANOTHER OBJECT of the present invention is to provide a support for wearing on the torso and supporting and raising a ceiling panel that is simple and inexpensive to manufacture.

STILL ANOTHER OBJECT of the present invention is to provide a support for wearing on the torso and supporting and raising a ceiling panel that is simple to use.

BRIEFLY STATED, YET ANOTHER OBJECT of the present invention is to provide a support for wearing on the torso and supporting and raising a ceiling panel. The support includes a harness that engages the torso and a frame that is operatively connected to the harness and supports and raises the ceiling panel. The frame includes a pair of rods that extend upwardly and alignigly along the harness and an H-pipe that has a pair of uprights. Termination ends of the pair of rods extend snugly through lower restricted bores in the H-pipe. The frame further includes a pair of coil springs that are captured in the pair of uprights of the H-pipe and sit on the termination ends of the pair of rods. Upper ends of the uprights of the H-pipe contain ball sockets. The frame further includes a pair of balls that are rollingly received in the ball sockets in the H-pipe so as to form ball joints. The pair of balls have necks that extend freely through upper restricted bores in the H-pipe and supporting portions that diverge from the necks. The supporting portions of the pair of balls have rubber pads thereon that are flat and raise the ceiling panel and support the ceiling panel when the ceiling panel is against a ceiling and the pair of coil springs provide tension thereon.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
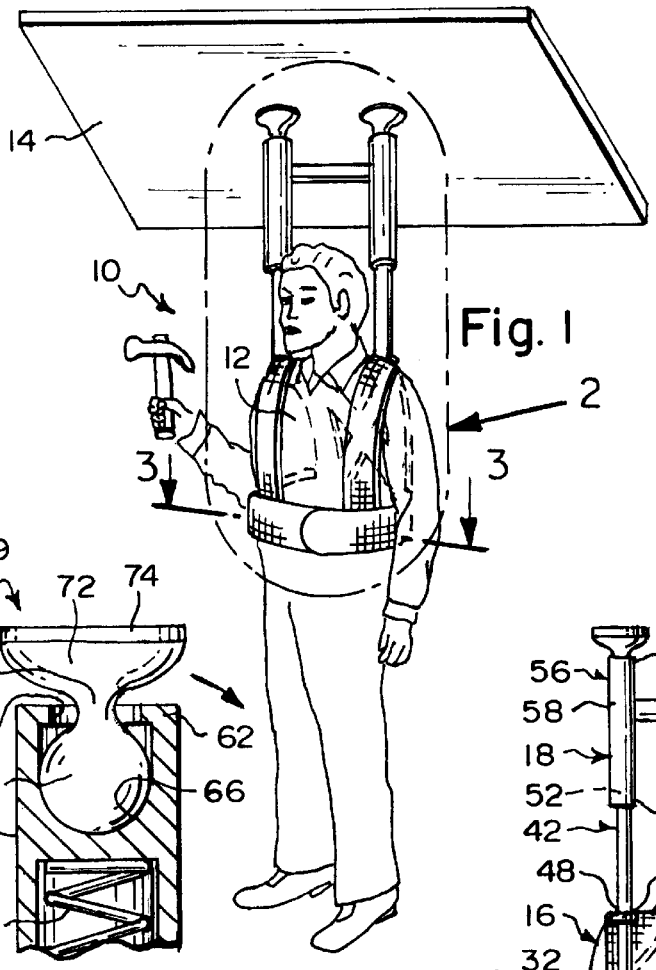
FIG. 1 is a diagrammatic perspective view of the present invention in use.

10 support for wearing on the torso and supporting and raising a ceiling panel of the present invention
12 torso
14 ceiling panel
16 harness for engaging torso 12
18 frame for supporting and raising ceiling panel 14
20 back engaging portion of harness 16 for engaging back of torso 12
22 chest engaging portion of harness 16 for engaging chest of torso 12
24 waist engaging portion of harness 16 for engaging waist of torso 12
26 substantially U-shaped member of back engaging portion 20 of harness 16
28 pair of legs defining substantially U-shaped member 26 of back engaging portion 20 of harness 16
29 free ends of pair of legs 28 defining substantially U-shaped member 26 of back engaging portion 20 of harness 16
30 pair of diagonal members of substantially U-shaped member 26 of back engaging portion 20 of harness 16
31 transverse portion of substantially U-shaped member 26 of back engaging portion 20 of harness 16
32 first pair of slender members of chest engaging portion 22 of harness 16 for engaging over shoulders of torso 12 and downwardly on chest of torso 12
33 back opposing surfaces of pair of legs 28 defining substantially U-shaped member 26 of back engaging portion 20 of harness 16
34 ends of first pair of slender members 32 of chest engaging portion 22 of harness 16
36 second pair of slender members of waist engaging portion 24 of harness 16 for engaging waist of torso 12
38 free ends of second pair of slender members 36 of waist engaging portion 24 of harness 16
40 hook and loop fasteners on free ends 38 of second pair of slender members 36 of waist engaging portion 24 of harness 16
42 pair of rods of frame 18
44 lower ends of pair of rods 42 of frame 18
46 sleeves on transverse portion 31 of substantially U-shaped member 26 of back engaging portion 20 of harness 16
48 intermediate points of pair of rods 42 of frame 18
50 collars on free ends 29 of pair of legs 28 of substantially U-shaped member 26 of back engaging portion 20 of harness 16
52 termination ends of pair of rods 42 of frame 18
54 spring seats on termination ends 52 of pair of rods 42 of frame 18
56 H-pipe of frame 18
58 pair of uprights of H-pipe 56 of frame 18
60 lower ends of pair of uprights 58 of H-pipe 56 of frame 18
61 lower restricted bores in lower ends 60 of pair of uprights 58 of H-pipe 56 of frame 18
62 upper ends of pair of uprights 58 of H-pipe 56 of frame 13
63 upper restricted bores in upper ends 62 of pair of uprights 58 of H-pipe 56 of frame 18
64 pair of coil springs of frame 13
66 ball sockets contained in upper ends 62 of uprights 58 of H-pipe 56 of frame 18
68 pair of balls of frame 18
69 ball joints of frame 18
70 necks of pair of balls 68 of frame 18
72 supporting portions of pair of balls 68 of frame 18
74 rubber pads on supporting portions 72 of pair of balls 68 of frame 18 for raising ceiling panel 14 and for supporting ceiling panel 12 when ceiling panel 14 is against ceiling and pair of coli springs 64 of frame 18 provide tension thereon

DETAILED DESCRIPTION OF THE PREFERRED EMBODIMENT

Referring now to the figures, in which like numerals indicate like parts, and particularly to FIG. 1, the support for wearing on the torso and supporting and raising a ceiling panel of the present invention is shown generally at 10 for wearing on the torso 12 and supporting and raising a ceiling panel 14.

Figure 2:
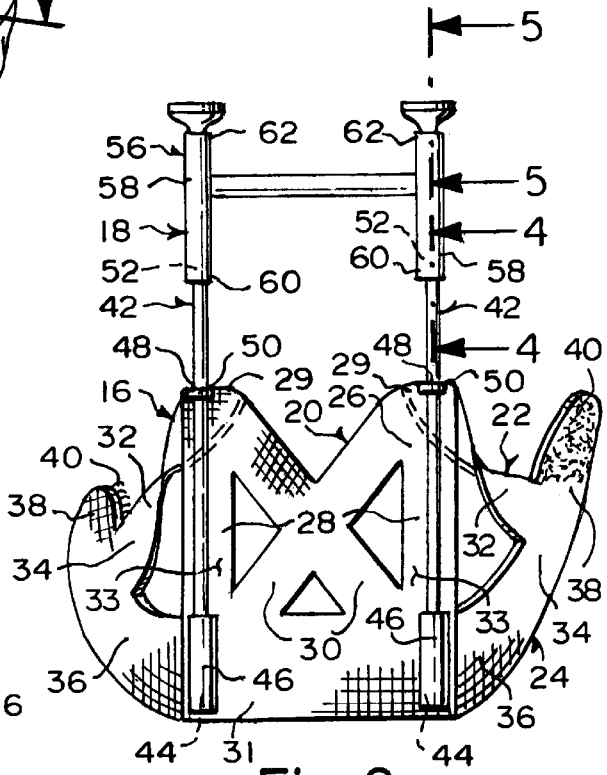
FIG. 2 is an enlarged diagrammatic rear elevational view of the area generally enclosed by the dotted curve identified by arrow 2 in FIG. 1 of the present invention.

The general configuration of the support for wearing on the torso and supporting and raising a ceiling panel 10 can best be seen in FIG. 2, and as such, will be discussed with reference thereto.

The support for wearing on the torso and supporting and raising a ceiling panel 10 comprises a harness 16 for engaging the torso 12, and a frame 18 operatively connected to the harness 16 for supporting and raising the ceiling panel 14.

Figure 3:
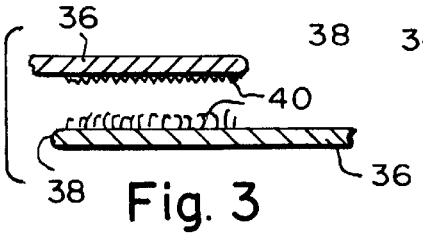
FIG. 3 is an enlarged exploded diagrammatic cross sectional view taken on line 3—3 in FIG. 1.

The specific configuration of the harness 16 can best be seen in FIGS. 2 and 3, and as such, will be discussed with reference thereto.

The harness 16 comprises a back engaging portion 20 for engaging the back of the torso 12, a chest engaging portion 22 for engaging the chest of the torso 12, and a waist engaging portion 24 for engaging the waist of the torso 12.

The back engaging portion 20 comprises a substantially U-shaped member 26 that is defined by a pair of legs 28 with free ends 29 and back opposing surfaces 33, and a transverse portion 31.

The substantially U-shaped member 26 further comprises a pair of diagonal members 30 that diagonally criss cross the pair of legs 28 of the harness 16.

The chest engaging portion 22 comprises a first pair of slender members 32 that extend forwardly from the free ends 29 of the pair of legs 28 of the harness 16, for engaging over the shoulders of the torso 12 and downwardly on the chest of the torso 12, where they terminate at ends 34.

The waist engaging portion 24 comprises a second pair of slender members 36 that extend collinearly from both ends, respectively, of the transverse portion 31 of the harness 16, for engaging the waist of the torso 12, meet the ends 34 of the first pair of slender members 32 of the harness 16, and terminate in free ends 38 that overlap each other and are maintained closed by hook and loop fasteners 40.

Figure 4:
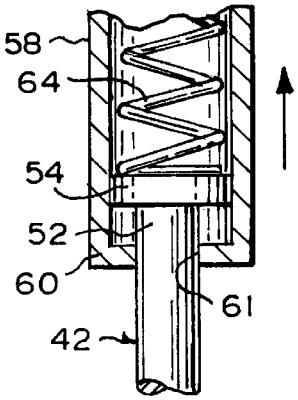
FIG. 4 is an enlarged cross sectional view taken on line 4—4 in FIG. 2.
Figure 5:
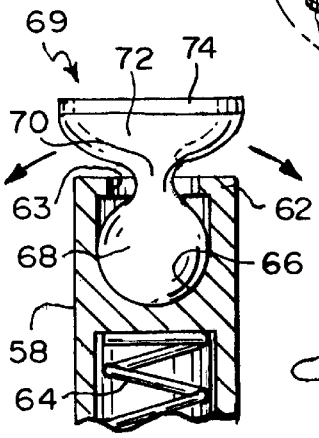
FIG. 5 is an enlarged cross sectional view taken on line 5—5 in FIG. 2.

The specific configuration of the frame 18 can best be seen in FIGS. 2, 4, and 5, and as such, will be discussed with reference thereto.

The frame 18 comprises a pair of rods 42 that extend upwardly and alignigly along the back opposing surfaces 33 of the pair of legs 28 of the harness 16, and have lower ends 44 that are received and maintained in sleeves 46 on the transverse portion 31 of the harness 16, intermediate points 48 that extend through and maintained in collars 50 on the free ends 29 of the pair of legs 28 of the harness 16, and termination ends 52 with spring seats 54 thereon that are wider than the termination ends 52 of the pair of rods 42.

The frame 18 further comprises an H-pipe 56 that has a pair of uprights 58 that are hollow and have lower ends 60 with lower restricted bores 61 and upper ends 62 with upper restricted bores 63.

The termination ends 52 of the pair of rods 42 extend snugly, respectively, through the lower restricted bores 61 in the H-pipe 56, and are prevented from escaping therefrom, by the springs seats 54 not being able to leave through the lower restricted bores 61 in the H-pipe 56.

The frame 18 further comprises a pair of coil springs 64 that are captured, respectively, in the pair of uprights 58 of the H-pipe 56, and sit on the springs seats 54.

The upper ends 62 of the uprights 58 of the H-pipe 56 contain ball sockets 66 that communicate with and are wider than the upper restricted bores 63 in the H-pipe 56.

The frame 18 further comprises a pair of balls 68 that are rollingly received, respectively, in the ball sockets in the H-pipe 56 so as to form ball joints 69, have necks 70 that extend freely, respectively, through the upper restricted bores in the H-pipe 56, and have supporting portions 72 that diverge, respectively, from the necks 70 with rubber pads 74 thereon that are flat for raising the ceiling panel 14 and for supporting the ceiling panel 12 when the ceiling panel 14 is against a ceiling and the pair of coil springs 64 provide tension thereon.

The rubber pads 74 are white for not marring the ceiling panel 14.

It will be understood that each of the elements described above, or two or more together, may also find a useful application in other types of constructions differing from the types described above.

While the invention has been illustrated and described as embodied in a support for wearing on the torso and supporting and raising a ceiling panel, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A support for wearing on the torso and supporting a ceiling panel, said support comprising:

a) a harness for engaging a human torso; said harness comprising:

i) a back engaging portion for engaging the back of the torso; said back engaging portion comprising a substantially U-shaped member defined by:

1) a pair of legs with free ends and back opposing surfaces; and 2) a transverse portion;

ii) a chest engaging portion for engaging the chest of the torso; and iii) a waist engaging portion for engaging the waist of the torso; and b) a frame operatively connected to said harness for supporting the ceiling panel; said frame comprising a pair of rods each having a given width and extending upwardly and aligningly along said back opposing surfaces of said pair of legs of said harness, and having:

i) lower ends received and maintained in sleeves on said transverse portion of said harness;

ii) intermediate points extending through and maintained in collars on said free ends of said pair of legs of said harness; and iii) termination ends with spring seats thereon each being wider than said given width of said rods.

2. The support as defined in claim 1, wherein said frame further comprises an H-pipe that has a pair of uprights that are hollow, each of said uprights having:

a) a lower end with a lower restricted bore; and b) an upper end with an upper restricted bore.

3. The support as defined in claim 2, wherein said termination ends of said pair of rods extend snugly, respectively, through said lower restricted bore in said H-pipe, and are prevented from escaping therefrom, by said springs seats restricting leave through said lower restricted bores said H-pipe.

4. The support as defined in claim 2, wherein said frame further comprises a pair of coil springs that are captured, respectively, in said pair of uprights of said H-pipe, and sit on said springs seats.

5. The support as defined in claim 4, wherein said upper ends of said uprights of said H-pipe each contain a ball socket that communicates with and is wider than said upper restricted bores in said H-pipe.

6. The support as defined in claim 5, wherein said frame further comprises a pair of balls that are rollingly received, respectively, in each of said ball sockets in said H-pipe so as to form ball joints.

7. The support as defined in claim 6, wherein said pair of balls each has:

a) a neck that extends freely, respectively, through a respective one of said upper restricted bores in said H-pipe; and b) a supporting portion that diverges, respectively, from said neck.

8. The support as defined in claim 7, wherein said supporting portions of said pair of balls have rubber pads thereon that are flat for raising the ceiling panel and for supporting the ceiling panel when the ceiling panel is against a ceiling and said pair of coil springs provide tension thereon.

9. The support as defined in claim 8, wherein said rubber pads are white for not marring the ceiling panel.

10. The support as defined in claim 1, wherein said chest engaging portion comprises a first pair of slender members that extend, respectively forwardly from said free ends of said pair of legs of said harness, for engaging over the shoulders of the torso and downwardly on the chest of the torso, where said first pair of slender members terminate at ends.

11. The support as defined in claim 10, wherein said waist engaging portion comprises a second pair of slender members that extend collinearly from both ends, respectively, of said transverse portion of said harness, for engaging the waist of the torso, meet the ends of said first pair of slender members of said harness, and terminate in free ends; said free ends of said second pair of slender members overlap each other and are maintained closed by hook and loop fasteners.

12. The support as defined in claim 1, wherein said substantially U-shaped member comprises a pair of diagonal members that diagonally criss cross said pair of legs of said harness.

* * * * *